US009492728B2

(12) United States Patent
Monroe

(10) Patent No.: US 9,492,728 B2
(45) Date of Patent: Nov. 15, 2016

(54) GOLF SWING TRAINING DEVICE

(71) Applicant: Brian Monroe, Escondido, CA (US)

(72) Inventor: Brian Monroe, Escondido, CA (US)

( * ) Notice: Subject to any disclaimer, the term of this patent is extended or adjusted under 35 U.S.C. 154(b) by 0 days.

(21) Appl. No.: 15/008,689

(22) Filed: Jan. 28, 2016

(65) Prior Publication Data

US 2016/0236056 A1 Aug. 18, 2016

Related U.S. Application Data

(60) Provisional application No. 62/117,876, filed on Feb. 18, 2015, provisional application No. 62/236,597, filed on Oct. 2, 2015.

(51) Int. Cl.
*A63B 69/36* (2006.01)

(52) U.S. Cl.
CPC ..... *A63B 69/36* (2013.01); *A63B 2208/0204* (2013.01)

(58) Field of Classification Search
USPC ..... 446/202–206, 216; 116/137 R
See application file for complete search history.

(56) References Cited

U.S. PATENT DOCUMENTS

| | | | | |
|---|---|---|---|---|
| 2,544,370 | A * | 3/1951 | Walther | G10D 7/12 446/208 |
| 3,730,530 | A * | 5/1973 | Oka | A63B 69/3635 273/DIG. 25 |
| 4,094,504 | A * | 6/1978 | Barasch | A63B 69/38 473/234 |
| 4,283,057 | A * | 8/1981 | Ragan | A63B 53/04 446/216 |
| 5,086,726 | A * | 2/1992 | Sharp | G10K 5/00 116/137 R |
| 5,885,126 | A * | 3/1999 | Carlson | A01M 31/004 446/208 |
| 7,581,509 | B2 * | 9/2009 | Eventoff | G10K 5/00 116/137 R |
| 2013/0085008 | A1 * | 4/2013 | Hall | A63B 69/3632 473/224 |

* cited by examiner

*Primary Examiner* — Nini Legesse
(74) *Attorney, Agent, or Firm* — David B. Waller

(57) ABSTRACT

A golf swing training device and method that provides audio feedback during practice swings for club head speed, orientation and release. The audible golf swing training device comprises: a whistle having an air inlet on the front end and an air outlet on the top; an air funnel affixed or integral to the front end to direct air into the air inlet; an air throttle means affixed over or between the air funnel and the air inlet to adjust the amount of air received by the whistle through the air funnel; and a connecting means affixed or integral to the base of the whistle for removably affixing the training device to a golf club.

12 Claims, 6 Drawing Sheets

GOLF SWING TRAINING DEVICE

CROSS-REFERENCE TO RELATED APPLICATIONS

This application claims priority to provisional patent application Ser. No. 62/117,876 filed 18 Feb. 2015.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

This invention relates to the general field of sports, and more specifically toward a training device and training method for swinging a golf club effectively when playing golf.

BACKGROUND OF THE INVENTION

One of the most difficult aspects of golf is learning to release, or unhinge, the wrists at the correct point in the swing. For some, it is possible to time the club head release correctly using various swing training devices or using the age-old method of holding the club upside down and listening for the club handle "whoosh" sound. Even so, it can be difficult to integrate these exercises into a regular golf swing. To make matters worse, the faster most novice golfers swing, the greater the tendency to cast the club, or to release the club too soon in the swing. A golfer may be able to time a slow swing, but as swing speeds increase so does the difficulty with properly releasing the club head.

A number of devices and methods have been developed to assist a golfer in learning how to swing a golf club effectively. U.S. Pat. No. 4,283,057 comprises a golf club with two built-in whistles perpendicular and parallel to the club head. U.S. Pat. No. 1,549,350 is an invention that permanently screws a whistle into the top of or onto the face of a golf club iron or driver. However, in both of these devices the whistles are embedded into a golf club and therefore cannot be removed and/or attached to other clubs. Additionally, the whistles have no means of being calibrated to the club head speed. It is therefore neither possible to make the whistle sound at slower swing speeds nor pre-calibrate or adjust an increasing minimum club head speed at which a properly executed swing will result in an audible sound.

U.S. Pat. No. 3,730,530 comprises of a whistle and suction cup that may be affixed to the top of a golf club driver. This invention, though removable, can only be attached to a golf club driver and not to an iron. Additionally, it lacks in the manner previously mentioned concerning U.S. Pat. Nos. 4,283,057 and 1,549,350 in that it has no means to pre-set or adjust the device to sound at increasingly faster swing speeds.

The "Swing Whistle" sold on www.swingwhistle.com is a hollow tube that attaches to a golf club hosel and creates a whistle effect as the club head begins to release in the swing. With this device there is no moment of truth during the swing when there is a clear and distinct sound; it is more of a high pitched whoosh over an indiscrete time frame in the swing. The device makes little to no sound at higher swing speeds and sounds whether or not the club head is square to the swing path. Consequently, the device neither provides clear guidance as to the proper club head speed nor orientation at the correct time in the swing. Additionally, it lacks in the manner previously mentioned concerning U.S. Pat. Nos. 4,283,057, 1,549,350 and 3,730,530 in that it has no means to pre-set or adjust the device to sound at increasingly faster swing speeds.

What is needed is a device and method that will provide an indicator, such as an audible sound, to alert the golfer when the club head is traveling at a certain speed and in the proper orientation at the moment of contact with the ball. Being able to hear exactly at what point in the swing the club head releases and squares to the swing path and knowing that the sound simultaneously indicates that the club head is travelling at a certain speed, would provide the golfer with invaluable feedback. This would allow the golfer to practice swinging the club faster and faster knowing not only that the club head is reaching a minimum swing speed but that it is squaring to the swing path and is releasing at the correct time in the swing.

SUMMARY OF THE INVENTION

The current invention is a golf swing training device that provides audio feedback, during practice swings, for club head speed and club head release. The device comprises a whistle, an air funnel affixed to the front of the air inlet of the whistle, an adjustment throttle means between the air funnel and air inlet or on the back end of the whistle and an attachment means to affix the device removably to a golf club. The whistle has a front end, a back end, a top, a base, an air inlet on the front end and an air outlet on the top. The adjustable air throttle means adjusts the amount of air received by said whistle through said air funnel and may be a valve or a gate. When the adjustable air throttle means is affixed between the air funnel and air inlet it may be a rotatable valve that adjusts the amount of air entering the inlet. In one configuration the valve is a louver. When the adjustable air throttle means is affixed on the back end, top or base of the whistle is may be a valve or a gate. In one configuration the gate is a rotatable wheel or slide panel having a plurality of apertures of increasingly larger size. By sliding the gate the user may adjust the amount of air released from the back of the whistle.

Another aspect of the present invention is a method of training an individual how to swing a golf club utilizing the audible golf swing device. The method comprises the steps of affixing the audible golf swing device to a desired golf club and swinging the club until an audible sound is produced and continuing to swing the club until the training device emits the audible sound consistently. The method may further comprise adjusting the air throttle adjustment means to increase or decrease the swing speed necessary for the training device to emit an audible sound.

In other embodiments of these aspects of the invention, the air throttle may be affixed to the front of the air funnel and may be pre-calibrated or adjustable. In one configuration, the air throttle means may be a plate having an elongated aperture that is oriented about perpendicular to the air inlet. The width of the aperture determines the club head speed at which the device makes an audible sound. For example, the width may range from about 0.1 mm to about 15 mm. In addition, the labium lip of the air outlet may be utilized to adjust the character and quality of the sound produced. The labium lip may be a flat edge, a stepped edge, a sloped edge or a rounded edge.

DETAILED DESCRIPTION OF THE INVENTION

Figure 1:
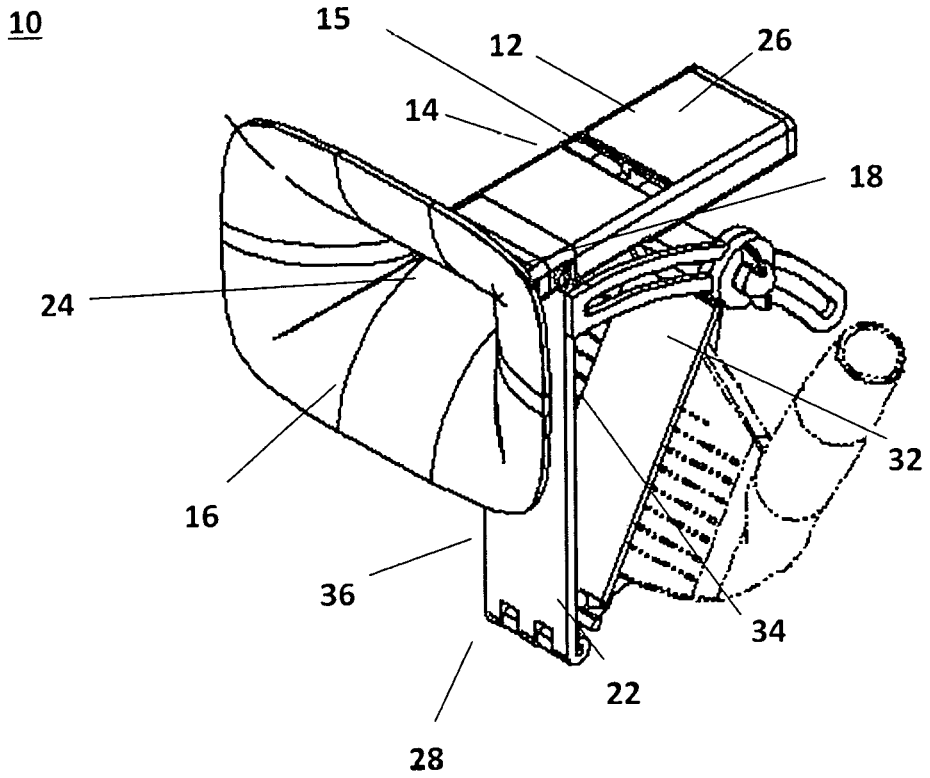
FIG. 1: Is a diagrammatic representation of a perspective view of the device affixed to a golf club. The golf club is merely shown to demonstrate the device when in use. The golf club is not part of the present invention.
Figure 2:
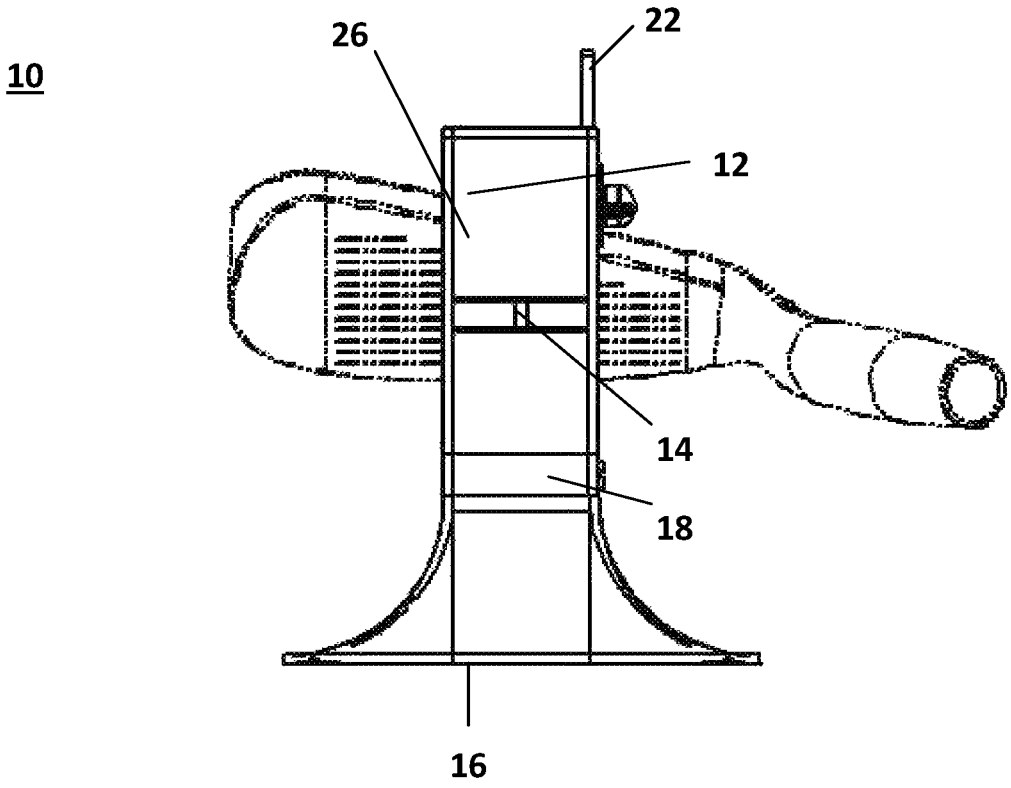
FIG. 2: Is a diagrammatic representation of a top view of the device affixed to a golf club. The golf club is merely shown to demonstrate the device when in use. The golf club is not part of the present invention.
Figure 3:
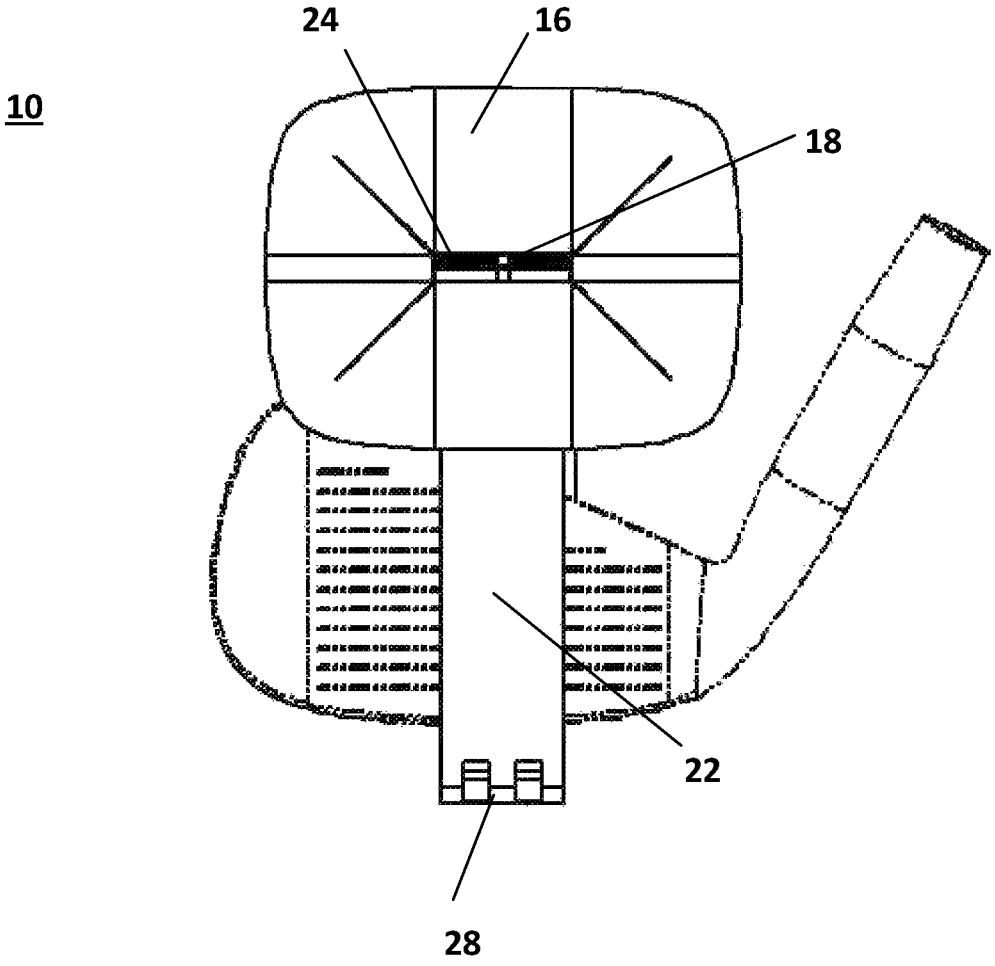
FIG. 3: Is a diagrammatic representation of a front view of the device affixed to a golf club. The golf club is merely shown to demonstrate the device when in use. The golf club is not part of the present invention.
Figure 4:
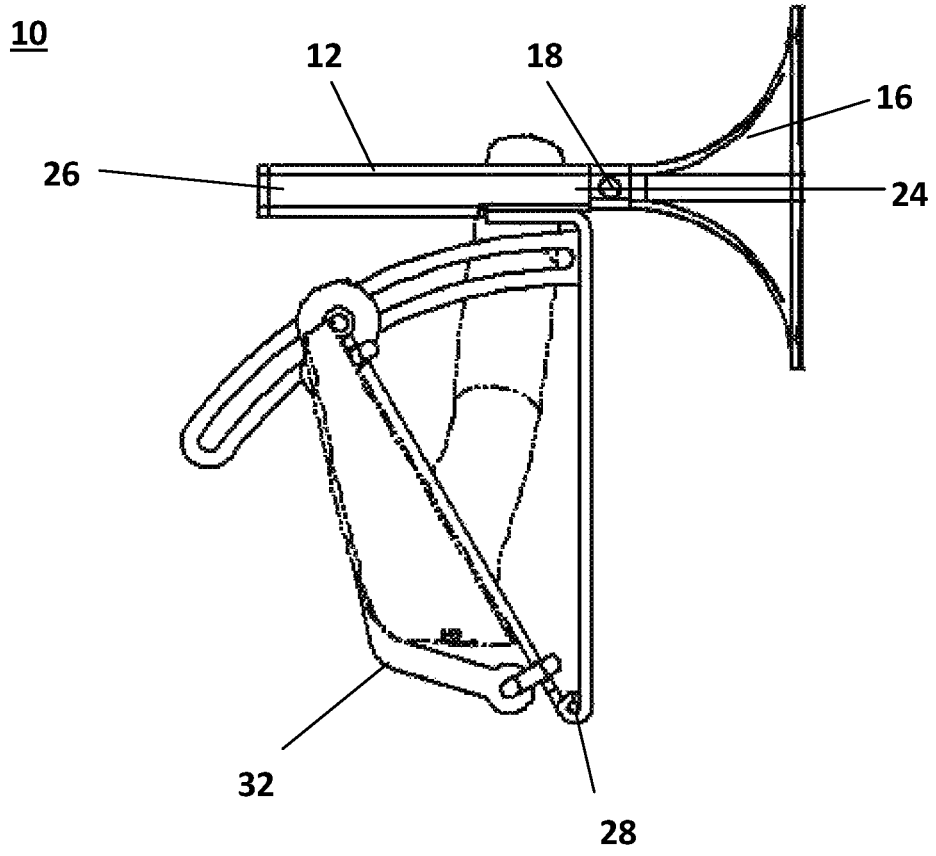
FIG. 4: Is a diagrammatic representation of a club head side view of the device affixed to a golf club. The golf club is merely shown to demonstrate the device when in use. The golf club is not part of the present invention.
Figure 5:
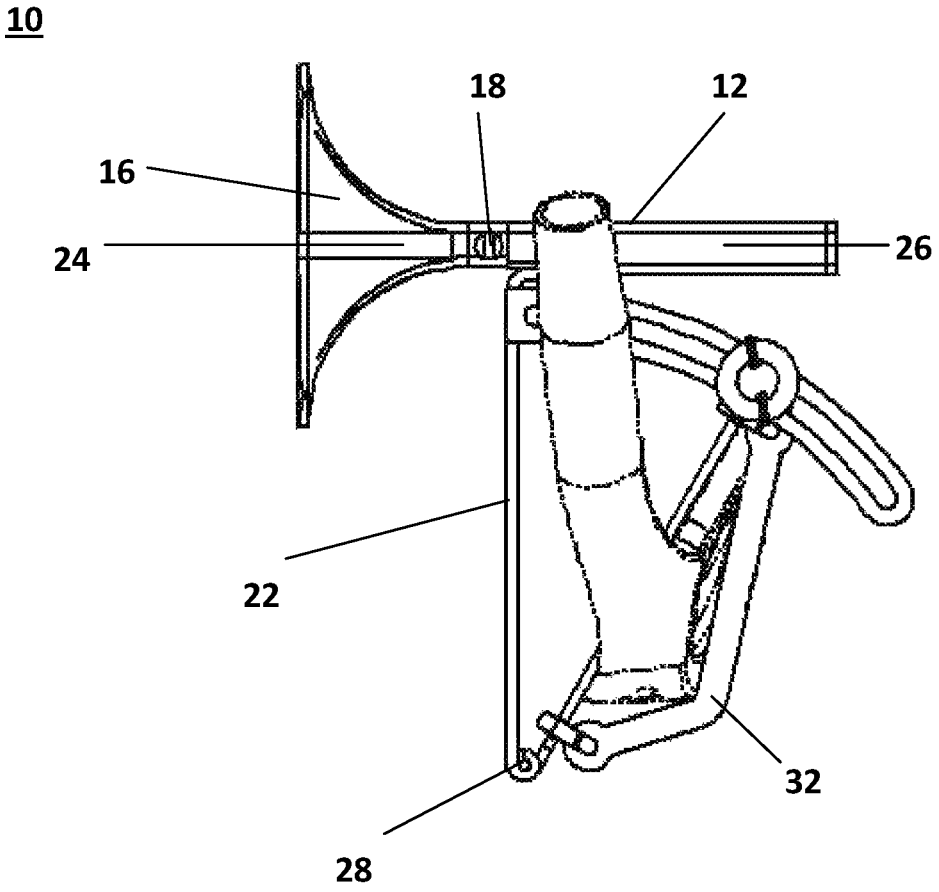
FIG. 5: Is a diagrammatic representation of a hosel side view of the device affixed to a golf club. The golf club is merely shown to demonstrate the device when in use. The golf club is not part of the present invention.
Figure 6:
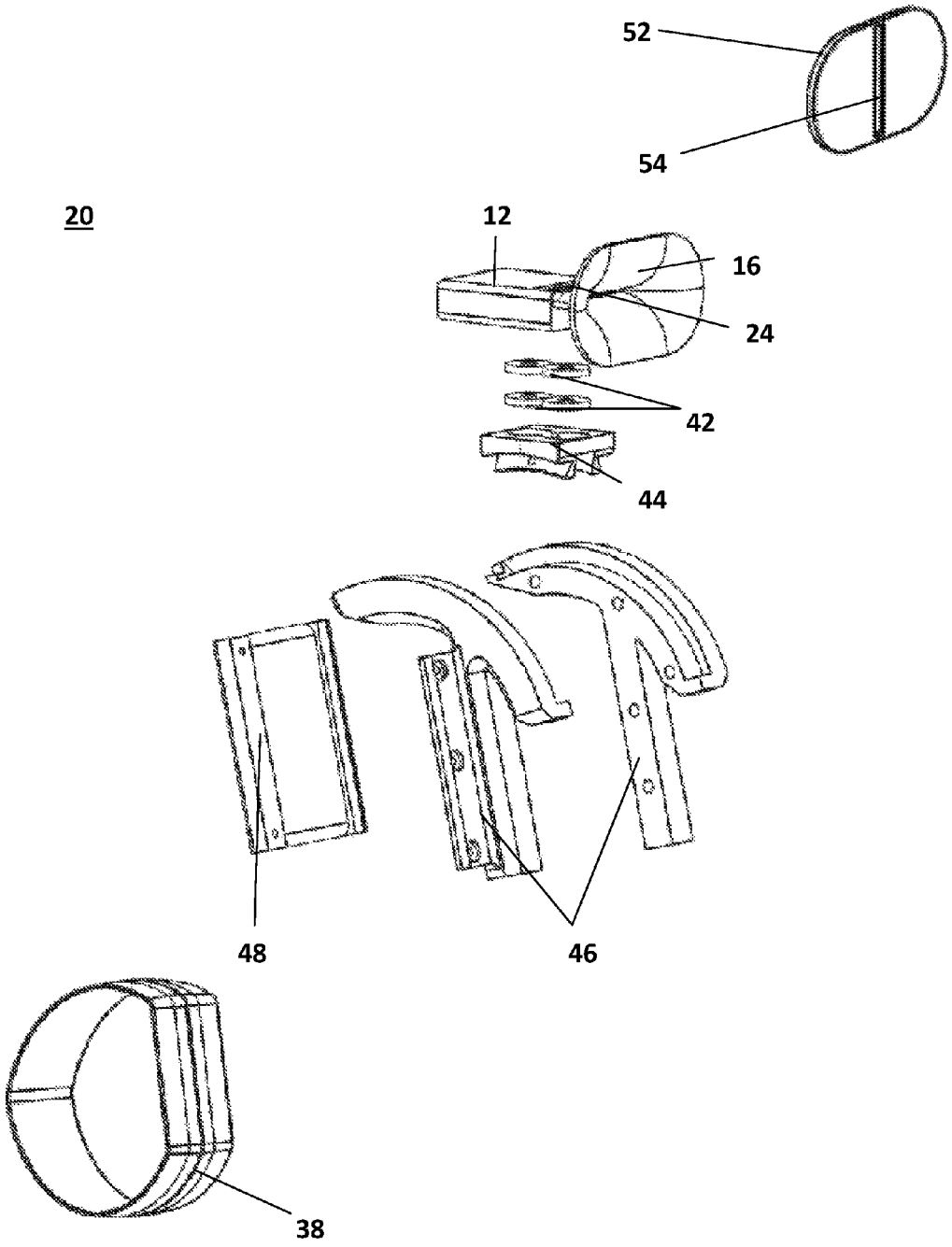
FIG. 6: Is an exploded view of one configuration of the device of the present invention.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "whistle" as used herein refers to the primary body of the device. The whistle comprises an air inlet on the front end, an air outlet on the top and a resonant chamber.

The term "air inlet" as used herein refers to the opening in the whistle through which air moves into the whistle and resonant chamber.

The term "air outlet" as used herein refers to the opening at the top of the whistle through which air exits the device.

The term "air funnel" as used herein refers to an element of the golf swing training device that acts to capture an amount of air through the large aperture front end of the funnel compressing that air as it moves through the narrowing neck of the funnel until it exits the smaller aperture at the back of the funnel, where it is affixed to the air inlet.

The term "air throttle adjustment means" as used herein refers to an element of the training device that may be used to adjust the amount of air entering the air inlet. The adjustment means may be prepared in a variety of configurations that are able to incrementally restrict the air that enters the air inlet. For example, the adjustment means may be a valve comprising a louver that is positioned across the air inlet. When turned the louver either reduces or increases the amount of air that may be delivered to the air inlet of the whistle. Other methods of controlling the audible sound emanating from the training device are encompassed by the air adjustment throttle means. For example, the adjustment means may be a rotatable wheel or slide panel having a series of incrementally larger diameter apertures that can reduce the pressure in the resonant chamber.

The term "affixing" as used herein refers to methods of connecting one element of the device to another. Examples of commonly used methods include snap-fit adapters that allow two parts to be fitted together and then securely snapped into position, adhesive or fusion.

The term "connecting means" as used herein refers to an element that allows the device to be removably affixed to a club. A variety of configurations may be prepared/created and utilized for this function. For example, a mounting bracket having a whistle contact section pivotally connected to a club head face contact section with an elastic band may be used. The club head face section is positioned flush against the club head face and secured with the elastic band. The whistle contact section is then pivoted so that the training device is parallel to the club head face and the plane of the front of the air funnel is perpendicular to the ground.

One aspect of this invention is an audible golf swing training device for a golf club. The device comprises: a whistle having an air inlet on the front end and an air outlet on the top; an air funnel affixed or integral to the front end to direct air into the air inlet; an adjustable air throttle means affixed between the air funnel and the air inlet to adjust the amount of air received by the whistle through the air funnel; and a connecting means affixed or integral to the base of the whistle for removably affixing the training device to a golf club.

Another aspect of the invention is a method of using the audible golf swing training device comprising the steps of affixing the device to a desired golf club and swinging the club until an audible sound is produced and continuing to swing the club until the training device emits the audible sound consistently.

In either of these aspects the air throttle may be affixed to the front of the air funnel and it may be pre-calibrated or adjustable. In one configuration, the air throttle means may be a plate having an elongated aperture that is oriented about perpendicular to the air inlet. The width of the aperture determines the club head speed at which the device makes an audible sound and may range from about 0.1 mm to about 15 mm. In addition, the labium lip of the air outlet may be utilized to adjust the character and quality of the sound produced. The labium lip may be a flat edge, a stepped edge, a sloped edge or a rounded edge.

Whistle

The mouthpiece of a whistle is shaped to create a narrow windway. The thin flow of air is directed against a narrow blade, called a labium or windcutter. The air stream does not simply split in two, but is unstable and oscillates rapidly back and forth between the two sides of the blade, creating a string of pressure pulses that radiate as sound waves. The resonant chamber of the whistle may be configured to make the whistle louder and/or tuned to a particular note. The oscillating airflow excites standing waves in the resonance chamber which in turn stabilize the frequency of oscillation. For flute type whistles the length of the chamber determines the resonant frequency and thereby the pitch of the whistle. The resonance chamber may also contain a small light ball, usually called the pea, which rattles around inside, creating a distinctive chaotic vibrating sound.

Sometimes, air or wind blowing past an opening can create a "Whistle" effect. A common one is air passing over the opening of a hollow tube having one closed end. This creates an audible frequency, which is resonated by the closed interior of the tube. However, this is not a true whistle.

A variety of whistles 12 may be utilized with the present invention. In one embodiment, a whistle 12 having a thin profile, also known as a "flat whistle", may be utilized to maintain the overall size of the device to a minimum. Flat whistles are usually provided in a rectangular hollow configuration having a length of about 1 inch to about 3 inches, a width of about ½ inch to about ¾ inch and a height of about ⅛ inch to about ¼ inch. For example, an Attwood Safety whistle is 2¼ inches by ¾ inches by 3/16 inch. The air inlet 24 is on one of the ¾ inch by 3/16 inch sides and the other is closed forming the resonant chamber 26. The air outlet 14 is on one of the 2¼ inch by ¾ inch sides and parallel to the air intake 24.

The whistle 12 may be made of a variety of materials such as wood, metal or plastic. It may be prepared in a single form molded or printed piece or assembled from two or more pieces. In one configuration, a flat whistle is prepared from a light weigh polymer in two pieces that may be adhered together by fusion or adhesive.

When investigating the whistle utilized in the present invention, it was found that the commercially available flat whistle labium lip 15 which forms the far edge of the voicing mouth was stepped. When this step was removed, an unexpected result was obtained in that the whistle now made a much clearer and louder sound in a much smaller speed range when the optimal club head speed was reached during a swing. It was further observed that modifying this lip 15 to be a flat edge, a sloped edge or a rounded edge caused different and unexpected results that could be harnessed to tailor the character of the sound, the speed range at which an audible sound is produced and the intensity of the sound.

Air Funnel

The air funnel 16 may be provided in a variety of configurations from round to rectangular. In one embodiment, the air funnel 16 is provided in an elongated rectangular configuration to maintain a reduced profile. For example, the front end or "large end" of the funnel may have a length of about 1 inch to about 4 inches, a width of about ¼ inch to about 1½ inches and a depth of about ½ to about 2 inches. The back end or "narrow end" of the funnel is provided with the same dimensions as the air intake 24 of the whistle 12. The sides of the funnel 16 may be planar or curved. In one configuration the sides of the interior of the funnel 16 are convex which may increase air speed based on Bernoulli's Principle. The funnel 16 may be made of a variety of materials such as wood, metal or plastic and may be made of the same material as the whistle 12. In one embodiment, the funnel 16 is made of the same plastic as the whistle 12 and is form molded or printed with the whistle 12 as a single piece. Alternatively, the narrow end of the air funnel 16 will have snap-fit adapters to allow the funnel 16 to be fitted up against the air intake 24 and snapped securely in place. The funnel 16 may also be connected to the air intake 24 by adhesive or fusion.

In use air enters the device 10 through the air inlet 24 via the air funnel 16, which is designed to maximize the application-specific effects of Bernoulli's Principle and the Venturi Effect by directing air into the device 10, reducing air pressure and accelerating air through the device 10.

When oriented properly, the air funnel 16 provides increased air flow to the whistle 12 that allows the whistle 12 to sound at a reduced club head speed.

Air Throttle Adjustment Means

The air throttle adjustment means 18 may be utilized to initiate the audible sound at particular club head swing speeds while substantially reducing or preventing sound at speeds slower than the desired speed. A variety of configurations may be utilized to provide the air throttle adjustment means 18. These may include adjusting the amount of air received by the air intake 24 during use or by reducing the pressure in the resonant chamber 26. In one configuration, the throttle adjustment means 18 is a valve having a stem that comprises a louver extending in front of and across the air intake 24 of the whistle 12. Turning the adjustment means rotates the louver either increasing or decreasing the air flow through the air intake 24. The valve may be provided at the narrow end of the air funnel or as part of the whistle 12 positioned in front of or within the air intake 24. The air throttle adjustment means 18 may be made of a variety of materials such as wood, metal or plastic and may be made of the same material as the whistle 12. In one embodiment, the adjustment means 18 is made of the same plastic as the whistle 12. In the configuration where the adjustment means 18 is positioned in the air funnel 16, an aperture may be prepared through the narrow end of the air funnel 16 with snap-fit adapters to allow the louvered stem of the valve to fit in and pass through both sides and snapped securely and rotatably in place. Alternatively, an aperture may be prepared through the air intake 24 of the whistle 12 with snap-fit adapters to allow placement of the valve at this location.

In still another configuration, the air throttle is pre-calibrated and is a plate 52 that is fitted over the air funnel 16 and air intake 24. In one example, the plate 52 contains an aperture 54 of a specified width running from the top to the bottom of the plate 52 and is positioned perpendicular to the air intake 24 of the whistle 12 when the plate 52 is secured on the air funnel 16. The width of the aperture 54 controls the amount of air that reaches the whistle 12 and regulates when the whistle is audible to the user based on the speed of the club head during a swing. The air throttle initiates the audible sound at a particular club speed, creating the sound at this speed or above. For example, when there is no air throttle affixed over the front of the air funnel the device may make an audible sound when the club head speed reaches 60 mph and above. When an air throttle plate 52 having an aperture 54 of 10 mm is affixed over the front end of the air funnel 16 an audible sound may be emitted at 70 mph and above, a 5 mm aperture 54 may produce a sound at 80 mph and above, a 3 mm aperture 54 may produce a sound at 90 mph and above, a 2 mm aperture 54 may produce a sound at 100 mph and above, a 1 mm aperture 54 may produce a sound at 115 mph and above and so on. One skilled in the art can prepare calibrated air throttles to affix to the front end of the air funnel 16 by preparing a plate 52 with an aperture 54 having a fixed width, attaching the device 10 or 20 to a club, and monitoring the club head speed when a sound is emitted from the device 10 or 20. That speed is then correlated with that club head speed.

A variety of air throttle plates 52 with different sized apertures 54 may be provided with the device 10 and 20. The user can select the speed based on the width of the aperture 54 and affix the plate 52 to the air funnel 16. Correspondingly, a number of whistles 12 may be provided with the throttle plates permanently affixed and the user simply changes the whistle 12 for the desired club speed. The throttle plates may be made of a variety of materials but are preferably made of the same material as the air funnel 16 or whistle 12.

In a similar configuration, the aperture 54 of the plate 52 may contain an opening running from the top to the bottom of the plate but is not provided in a set predetermined width.

In a similar configuration the aperture of the plate may be adjustable. For example, the aperture size can be determined by two interconnected sliding panels affixed to the plate 52. When sliding one panel, both panels move maintaining the center alignment of the aperture 54 on the plate 52. Thus it is possible to adjust the aperture size of the plate 52 by sliding a panel inward or outward, which changes the size of the aperture 54 and thus the speed at which the device 10 and 20 will emit a sound. As the slide panels are adjusted to various positions it is possible for the user to change the aperture size and thus cause the device to emit a sound at many different swing speeds between the slowest and the fastest speed. With the slide panels fully opened, forming the largest aperture size, the device emits a sound at the slowest club head speed. With successively smaller aperture widths the device emits sound at faster club head speeds.

In another configuration a plurality of aperture widths are provided on a gate that is slidably affixed to the plate such that the user may easily slide the gate from one side of the plate to the other until the desired elongated aperture width is obtained. A variety of configuration may be utilized with the present invention, known to those skilled in the art, for varying the width of the elongated aperture in the plate and thereby determining the club head speed at which the device will make on audible sound.

In another configuration, the air throttle adjustment means 18 increases or reduces the amount of pressure in the resonant chamber 26 thereby effecting the emitting of a sound from the device based on speed. In this configuration, the whistle 12 contains a fixed size aperture covered by a rotatable wheel or slide panel having a plurality of apertures of incremental sizes. The largest aperture size of the rotatable wheel or slide panel is equivalent to the aperture in the whistle 12. In addition, the wheel or panel will have a position in which there is no aperture enabling the resonant chamber 26 to be closed if desired. The wheel or panel may be made of a variety of materials such as metal or plastic. In one embodiment, the wheel or panel is made of the same material as the whistle 12. In the wheel configuration, the wheel may be held onto the whistle 12 by a central pin that allows the wheel to rotate or may be held in place by a circular guide that receives the perimeter edge of the wheel. In the slide panel configuration, the slide may be held in place by guide rails that receive the top and bottom of the panel. To maintain the wheel or panel at a particular location there may be a series of nipples on the whistle 12 and corresponding dimples on the wheel or panel to allow for selection of the appropriate aperture yet maintain the wheel or panel in place during use. Other methods known to those skilled in the art may be used to achieve this purpose.

In the case of a device with an air throttle located inside the air inlet 24, when the air throttle adjustment means 18 is fully opened, the device 10 will emit a sound at the slowest swing speed. As the air throttle 18 begins to close it causes the device to emit a sound at higher and higher swing speeds. The golfer thus can challenge him or herself to develop increased club head speed by increasing the air throttle speed and continuing to take practice swings in an attempt to generate a sound.

Connecting Means

A variety of configurations of a connecting means 22 that align both square to the club face and parallel to the bottom of the club may be utilized with the present invention. Proper alignment of the device 10 by the connecting means 22 allows it to emit a sound when the club face is square to the swing path and when the club face is travelling at the minimum club head speed set by the air throttle 18.

The connecting means 22 may be made of a variety of materials including wood, metal or plastic, which may be the same or different from the material used to prepare the whistle 12. In one configuration, the connecting means may be provided as a hinged bracket 28 having two sides and snap clips 32 on the ends of the two sides where they meet when fitted about the club head. When snapped in place the connecting means 22 is tightly secured to the club head. The whistle 12 with air funnel 16 may be integral to the connecting means 22 or the connecting means 22 may provide a platform on which the whistle 12 with air funnel 16 may be tightly secured. Alternatively, the connecting means 22 may be provided as a hinged platform 28 having an elastic band 38 that secures the platform 28 to the club head. The hinged platform 28 may comprise two components: the club face component 34 that fits flush against the club face; and the whistle platform 36 wherein the hinge between these two components allows the whistle 12 and air funnel 16 to be adjusted for proper alignment during use. The whistle 12 with air funnel 16 may be integral to the whistle platform 36 or it may be provided separately. The elastic band 38 fits through apertures provided in the club face component to secure the connecting means 22 tightly to the club head. Similar to this configuration, the connecting means 22 may be provided wherein the platform does not comprise a hinge but is fixed. In this configuration, fixed platforms may be provided one for each club wherein the platform for an iron is triangular shaped and L-shaped for the drivers.

In another configuration, the connecting means 22 comprises a slide 44 having magnetic attachments 42, a slide guide 46, a base plate 48 and elastic band 38. In this configuration, the base of the whistle 12 contains one or more magnets 42 and/or magnetically susceptible metal plates. The slide 44 also comprises one or more magnets 42 and/or magnetically susceptible metal plates that interface with the magnets and/or metal plates on the base of the whistle 12. The magnets provide sufficient force to maintain the whistle in place during varying speed swings. The slide guide 46 may be provided in one or more pieces and provides the guide in which the slide 44 fits and allows the user to adjust the angle of the air funnel 16 and whistle 12 so that the funnel is relatively perpendicular to the swing trajectory based on the club selected. The slide guide 46 and/or the slide 44 may be provided with elements that help to secure the whistle 12 at a desired position along the slide guide 46, such as notches, grooves, ridges or knobs. The base plate 48 is secured to the slide guide 46 and secures the elastic band to the device 20. The base plate 48 may act as a clip in which the elastic band is slipped and secured or the elastic band 38 may be secured between the base plate 48 and the slide guide 46 when they are secured together.

In a similar configuration, the connecting means comprises a variety of attachment means such as a snap or clip attachment as opposed to magnetic attachments.

In another configuration, the connecting means comprises a small shelf with clamp that attaches directly to the club hosel. The clamp may be connected to the hosel in a variety of configurations including a bolt with hand-tightened wing-nut, and rubber insert to both protect the hosel where it comes in contact with the clamp and provide friction to prevent the clamp from slipping during practice swings. The shelf, which is integral to the clamp, attaches to the whistle and funnel. The shelf extends from the clamp at an angle and pitch that aligns the attached whistle and funnel both square to the club face and perpendicular to the ground, when the club is held properly by the golfer at address. The shelf may attach to the whistle in a variety of ways including Velcro™, magnets, snap or clip attachments. The clamp and shelf may be integrated with the whistle and funnel as one piece or may be provided such that the whistle and funnel can be removably attached.

Assembly

In one embodiment the device is provided in a single unit requiring no assembly other than to affix the device to a golf club. In another embodiment, the device may be provided in two or more pieces, requiring assembly. In a multiple piece configuration, the device may be a whistle an air funnel and a connecting means. Prior to use, the golfer must affix the air funnel to the air intake and select the appropriate connecting means. An L-shaped connecting means may be utilized for a driver and a triangular shaped connecting means for an iron. The connecting means is affixed to the golf club head via a flexible band. The connecting means is aligned in the center of the club head face. Next, the whistle with the air funnel is affixed to the connecting means. The device is aligned parallel to the bottom of the club and square to the club face. To expedite assembly, these parts may be provided with snap-fit connections.

In another multiple piece configuration, the device comprises two pieces: a connecting means having an elastic band connected to a slide guide having a magnetic slide fitted within the guide and an air funnel affixed to a whistle with one or more magnets secured on its base. In this configuration, the user selects a club and affixes the connecting means to the club head using the elastic band. Next the user selects the whistle that is calibrated to make a sound at the desired speed and connects the whistle to the connecting means via the one or more magnets. Alternatively, the user connects the whistle to the connecting means via the one or more magnets and then selects the pre-calibrated throttle plate that will allow the whistle to sound at the desired club head speed and affixes that plate to the front of the air funnel. If multiple whistles are provided with the pre-calibrated throttle plate permanently affixed to the air funnel, the user merely selects the whistle for the desired club head speed.

In another configuration, the device comprises a connecting means that affixes directly to the club hosel. The whistle is integrated with the funnel and attaches to the connecting means. In this configuration, the user selects a club and affixes the connecting means to the club hosel using the clamp. Next the user selects a whistle, that is equipped with a funnel and throttle pre-calibrated to a specific speed, and attaches it to the connecting mean's shelf via Velcro™, magnets, or snap fit attachments. Alternately, the user affixes the whistle to the connecting means and then selects a pre-calibrated throttle plate, that will enable the whistle to sound at a specific speed, and affixes it to the front of the funnel.

Use

One use of the device is to develop the correct timing of club head release in the golf swing. To practice correct club head release timing, the golfer attaches the training device to a golf club using a connecting means. The golfer then takes practice swings listening for when the device emits a sound. The device will emit a sound when the club head releases. Thus swinging the club, the golfer can hear when in the swing the club head releases. Often the novice golfer will cast the club or release the club too soon in the swing. Training with the device, the golfer can listen and make adjustments to release the club later in the swing, typically at or after impact.

Another use for the device is to develop increased golf swing speed while maintaining proper club head release. To develop increased swing speed the golfer attaches the device to a club using a connecting means. The golfer then takes practice swings listening for the device to emit a sound. The golfer then adjusts the air throttle on the device to higher and higher swing speeds and continues taking practice swings. The golfer continues to increase the air throttle on the device until it will no longer emit a sound. As the golfer is able to push past this upper limit, the golfer learns to not only to swing faster but also to continue to swing in a manner that makes the device sound at the correct time in the swing. In so doing, the golfer develops increased swing speed and correct timing of the release of the club head.

In a similar use, the device may be provided with a number of air throttle plates that may be attached to the air funnel of the device or multiple whistles with air funnels to which the air throttles have been permanently affixed. In either case, the plates and/or whistles each have a specified club head speed at which an audible sound is produced.

Another use of the device is to teach the golfer to square the club face longer in the golf swing. Squaring the club face longer in the golf swing, especially through the area where the club face strikes the ball, allows the golfer to hit more consistently accurate golf shots. To square the club face longer in the swing the golfer attaches the device to a golf club using a connecting means and takes practice swings listening for how long the device emits a sound. The golfer then attempts to make the device sound for a longer period of time, especially through the impact zone. A typical novice golfer flips the club, or cups the left wrist (in the case of a right-handed golfer) immediately after the club head releases, thereby adding loft and taking the club face out of square to the swing path. A golfer adjusts to make the device sound for a longer time in the swing, typically through the impact zone, eliminating flipping and at the same time learning to square the club face longer in the swing.

Another use for the device is to develop better control over hitting high and low trajectory golf shots. Being able to hit high and low trajectory shots provides the golfer a means to control the ball flight for different course conditions. To develop better control over hitting high and low trajectory golf shots the golfer attaches the device to a club head via the connecting means and takes practice swings attempting to make the device sound at impact. When the device sounds at impact it indicates that the club is released at impact which produces a higher trajectory golf shot. Similarly the golfer may take practice swings attempting to make the device sound after impact. When the device sounds after impact it indicates that the club is released after impact which produces a lower trajectory golf shot. Thus practicing, a golfer can learn to release the club head in a manner which produces both high and low trajectory golf shots.

I claim:

1. An audible golf swing training device for a golf club comprising:

a whistle having a front end, a back end, a top, a base, an air inlet on said front end and an air outlet on said top;

an air funnel affixed to or integral to said front end to direct air into said air inlet;

an air throttle means affixed over or between said air funnel and said air inlet to adjust the amount of air received by said whistle through said air funnel wherein said air throttle means is a plate having an elongated aperture, wherein said plate is affixed over said air funnel and wherein said elongated aperture is oriented about perpendicular to said air inlet; and a connecting means affixed to or integral to said base for removably affixing said training device to said golf club.

2. The audible golf swing training device for a golf club according to claim 1, wherein the width of said elongated aperture determines the club head speed at which the device makes an audible sound.

3. The audible golf swing training device for a golf club according to claim 1, wherein said width ranges from about 0.1 mm to about 15 mm.

4. The audible golf swing training device for a golf club according to claim 1, wherein said plate comprises an adjustable gate or slide panel that adjusts the width of the opening of said elongated aperture.

5. The audible golf swing training device for a golf club according to claim 4, wherein said slide panel comprises two interconnected slide panels.

6. The audible golf swing training device for a golf club according to claim 1, wherein said air outlet comprises a labium lip and wherein said labium lip is a flat edge, a stepped edge, a sloped edge or a rounded edge.

7. A method of training an individual to swing a golf club comprising:

affixing to said golf club an audible golf swing training device comprising a whistle having a front end, a back end, a top, a base, an air inlet on said front end and an air outlet on said top; an air funnel affixed to or integral to said front end to direct air into said air inlet; an air throttle means affixed over or between said air funnel and said air inlet to adjust the amount of air received by said whistle through said air funnel wherein said air throttle means is a plate having an elongated aperture, wherein said plate is affixed over said air funnel and wherein said elongated aperture is oriented about perpendicular to said air inlet; and a connecting means affixed to or integral to said base for removably affixing said training device to said golf club; and swinging said golf club having said audible golf swing training device affixed wherein said audible golf swing training device emits an audible sound when said golf club is oriented perpendicular to said golfer's swing path and at the proper speed and wherein said golfer repeats said swing until said training device consistently emits said audible sound.

8. The method according to claim 7, wherein the width of said elongated aperture determines the club head speed at which the device makes an audible sound.

9. The method according to claim 8, wherein said width ranges from about 0.1 mm to about 15 mm.

10. The method according to claim 7, wherein said plate comprises an adjustable gate or slide panel that adjusts the width of the opening of said elongated aperture.

11. The method according to claim 10 wherein said slide panel comprises two interconnected slide panels.

12. The method according to claim 7, wherein said air outlet comprises a labium lip and wherein said labium lip is a flat edge, a stepped edge, a sloped edge or a rounded edge.

* * * * *

UNITED STATES PATENT AND TRADEMARK OFFICE

CERTIFICATE OF CORRECTION

PATENT NO. : 9,492,728 B2
APPLICATION NO. : 15/008689
DATED : November 15, 2016
INVENTOR(S) : Brian Monroe It is certified that error appears in the above-identified patent and that said Letters Patent is hereby corrected as shown below:

In the Claims

Column 11, Line 9, in Claim 3, delete “claim 1” and insert --claim 2--

Signed and Sealed this
Twenty-fifth Day of July, 2017

Joseph Matal

Joseph Matal
*Performing the Functions and Duties of the*
*Under Secretary of Commerce for Intellectual Property and*
*Director of the United States Patent and Trademark Office*